US007470160B1

(12) United States Patent
Mostoller et al.

(10) Patent No.: US 7,470,160 B1
(45) Date of Patent: Dec. 30, 2008

(54) CARD EDGE CABLE CONNECTOR

(75) Inventors: Matthew Edward Mostoller, Hummelstown, PA (US); Christopher George Daily, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/758,699

(22) Filed: Jun. 6, 2007

(51) Int. Cl.
*H01R 4/02* (2006.01)

(52) U.S. Cl. ..... 439/874; 439/856

(58) Field of Classification Search ..... 439/59, 439/493, 494, 856, 877, 874, 326, 636
See application file for complete search history.

(56) References Cited

U.S. PATENT DOCUMENTS

| | | | | | |
|---|---|---|---|---|---|
| 2,385,915 | A | * | 10/1945 | Hagedorn et al. | 439/851 |
| 2,794,176 | A | * | 5/1957 | Barnes | 439/874 |
| 3,075,167 | A | * | 1/1963 | Kinkaid | 439/636 |
| 3,137,537 | A | * | 6/1964 | Cole et al. | 439/493 |
| 3,740,702 | A | * | 6/1973 | Moray | 439/866 |
| 4,087,146 | A | * | 5/1978 | Hudson, Jr. | 439/67 |
| 4,749,361 | A | | 6/1988 | Verhoeven | |
| 4,776,803 | A | * | 10/1988 | Pretchel et al. | 439/59 |
| 4,778,404 | A | * | 10/1988 | Pass | 439/387 |
| 5,188,543 | A | * | 2/1993 | Swift | 439/620.09 |
| 5,238,411 | A | * | 8/1993 | Jinno et al. | 439/59 |
| 5,409,385 | A | | 4/1995 | Tan et al. | |
| 6,494,781 | B2 | * | 12/2002 | Fujita et al. | 439/635 |
| 6,652,322 | B2 | * | 11/2003 | Ito et al. | 439/637 |
| 6,722,915 | B1 | | 4/2004 | McAlonis et al. | |
| 6,729,910 | B2 | * | 5/2004 | Fuller | 439/668 |
| 6,832,933 | B2 | * | 12/2004 | Bu et al. | 439/637 |
| 6,932,659 | B1 | * | 8/2005 | Wong | 439/853 |
| 2004/0235353 | A1 | * | 11/2004 | Katsumata et al. | 439/630 |
| 2005/0221690 | A1 | | 10/2005 | Suzuki et al. | |
| 2006/0189195 | A1 | * | 8/2006 | Okada | 439/325 |
| 2008/0009179 | A1 | * | 1/2008 | Tadokoro | 439/493 |

FOREIGN PATENT DOCUMENTS

| | | |
|---|---|---|
| DE | 10 2004 054535 | 3/2006 |
| EP | 0 544 184 | 6/1993 |
| GB | 979211 | 1/1965 |

* cited by examiner

*Primary Examiner*—Tulsidas C. Patel
*Assistant Examiner*—Vladimir Imas

(57) ABSTRACT

An electrical connector for connecting a cable to a card edge interface has a housing portion. The housing portion has a first surface, and a second surface opposite said first surface, and the surfaces are spaced apart to define a housing portion slot for the card edge interface. Furcated contact elements are disposed within the housing. Each contact element has a first tine portion with an exposed contact interface portion, a second tine portion; a web portion connecting the first and second tine portions, and a wire termination portion for terminating a conductor of the cable. The first and second tine portions are arranged within the housing portion with the contact interface exposed for mating with a respective contact surface of the card edge interface.

17 Claims, 7 Drawing Sheets

CARD EDGE CABLE CONNECTOR

FIELD OF THE INVENTION

The present invention is directed to a cable electrical connector, and more specifically to an electrical connector for connecting a multiple conductor power or signal cable to an edge of a printed circuit board (PC card) card.

BACKGROUND

Connector assemblies are required to provide electrical power or electrical or electronic control signals between components, such as computers, printers, auxiliary hardware, etc. Often these components contain panel members, such as PC cards, which are populated with miniaturized components to provide the desired electrical control. Usually, the connector assembly includes electrical contacts that extend from a housing that is secured adjacent to one end of the panel member. A mating connector assembly is configured for receiving the connector assembly. The operational reliability of the component is directly affected by the integrity of the connection. That is, if there is an insufficient electrical connection between the contacts, the components cannot operate as intended. In some applications, such as where the PC card contains high-powered light-emitting diodes (LEDs), the PC card and associated contacts are exposed to high temperatures, causing stress relaxation of the metal connector components. Stress relaxation of the connector components further exacerbates the problem by creating intermittent opening of the contacts, and reducing the normal force applied to the electrical contact points.

What is needed is a card edge cable connector that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to an electrical connector for connecting wire or cable to a card edge interface. The electrical connector has a housing portion. The housing portion has a first surface, and a second surface opposite said first surface. The first and second surfaces are spaced apart to define a slot. A plurality of furcated contact elements is disposed within the housing. Each contact element has a first tine portion including a contact interface portion, a second tine portion spaced apart from the first tine portion; a web portion connecting the first and second tine portions at one end, and a wire termination portion attached to the web portion for terminating a conductor of the cable. The first and second tine portions define an open recess corresponding with the housing portion slot, and are arranged within the housing portion with the contact interface exposed for mating with a respective contact surface of the card edge interface, the slot formed by the housing portion, and the contact elements receiving the card edge interface.

Another embodiment relates to an electrical connector for connecting a cable to a card edge interface. The electrical connector has a housing portion. The housing portion has a first surface, and a second surface opposite said first surface. The first and second surfaces are spaced apart to define a housing portion slot for receiving the card edge interface. A plurality of furcated contact elements is disposed within the housing. Each contact element has a first tine portion including a contact interface portion, a second tine portion spaced apart from the first tine portion; a web portion connecting the first and second tine portions at one end, and a wire termination portion attached to the web portion for terminating a conductor of the cable. The first and second tine portions define an open recess corresponding with the housing portion slot, and are arranged within the housing portion with the contact interface exposed for mating with a respective contact surface of the card edge interface. Each contact element is configured with a first slot having a projection defining a secondary slot; the secondary slot being filled with housing material flowed around the projection, wherein the contact element is secured within the housing portion.

Another embodiment relates to furcated contact element for an electrical connector. The connector includes a first tine portion with a contact interface portion; a second tine portion spaced apart from the first tine portion; a web portion connecting the first and second tine portions at one end, and a wire termination portion attached to the web portion for terminating a conductor of a cable. The first and second tine portions define an open recess corresponding with a slot of a housing portion. The tine portions are arranged within the housing portion with the contact interface exposed for mating with a respective contact surface of a card edge interface, the slot formed by the housing portion, and contact elements receiving the card edge interface. The wire termination portion has a cup portion for receiving molten solder. The cup portion defines an aperture that is substantially coaxial with the plane of the contact element. An axis of the conductor is maintained approximately at the centerline of the contact element when the conductor is soldered to the contact element.

Yet another embodiment is directed to a solder cup to provide a solder connection to a wire termination. The solder cup includes a cup portion having a first beam portion and a second beam portion. The first beam portion is disposed on one side of a centerline of the cup portion and the second beam portion is disposed opposite the first beam portion. The first and second beam portions define an aperture for inserting a wire conductor prior to receiving the molten solder. The cup portion is configured to receive molten solder and retain a portion of the solder in solid form. An axis of the conductor is maintained approximately at the centerline of the contact element when the conductor is soldered to the contact element.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Figure 1:
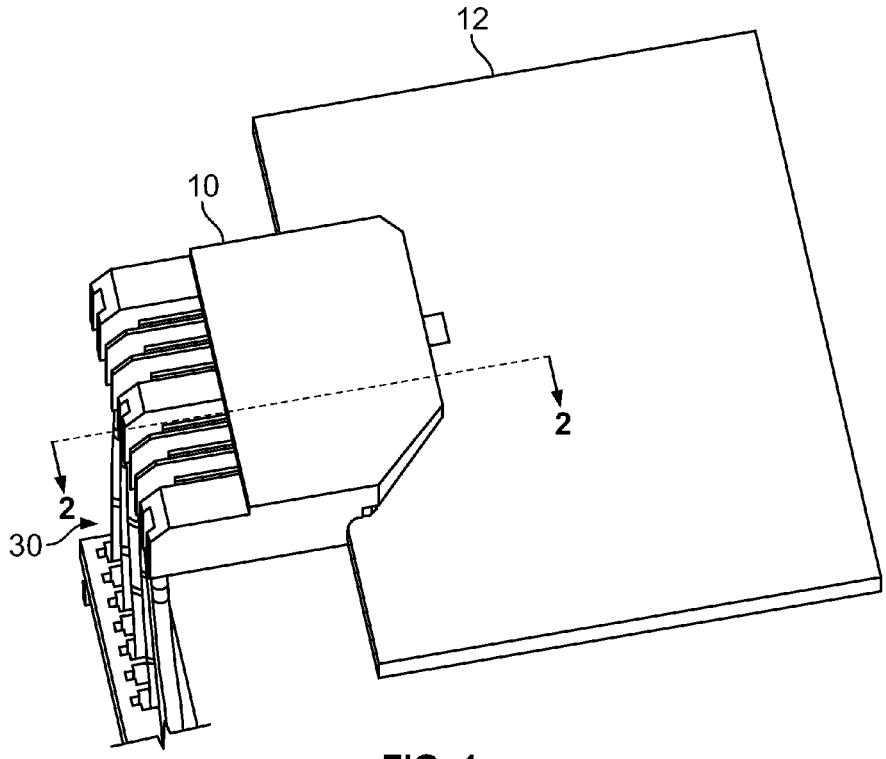
FIG. 1 is a perspective view of the card edge cable connector and PC card.
Figure 2:
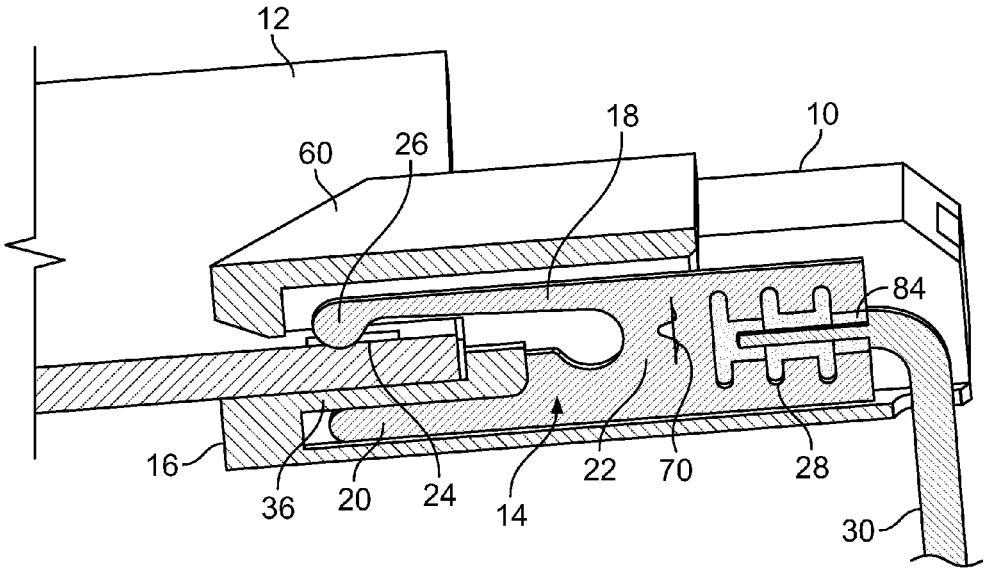
FIG. 2 is a cross-sectional view of the connector taken along the lines 2-2 in FIG. 1.

Referring first to FIGS. 1 and 2, a card (or edge cable connector 10 and PC card 12 are shown. Electrical contact elements 14 are inserted within a housing portion 16. The housing portion 16 is an electrically insulating material. A high-temperature resin may be employed for applications that expose the connector 10 to high temperatures, e.g., if the components of the PC card 12 include high-temperature LEDs, or if the card or PC card substrate has an aluminum core for heat dissipation.

Furcated contact elements 14 include an upper tine 18 and a lower tine portion 20. The upper tine portion 18 and lower tine portion 20 are joined at one end by a web portion 22. The novel furcated design provides a high normal contact force for reliable and stable connection to the plated contacts 24 of the PC card 12, while maintaining a tight contact-to-contact centerline or pitch. The web portion 22 provides a reinforced joint at the intersection of the upper and lower tine portions 18, 20, which is resistant to metal deformation due to heat- and mechanically-induced stresses, as described in greater detail below. A plated interface 26 aligns with the plated PC card contacts 24. The contact base material may be a high-temperature copper alloy, e.g., phosphor bronze, beryllium copper, or similar copper alloys with resistance to stress relaxation, as will be known to those skilled in the art. A wire termination portion 28 is disposed on the contact element 14 at the end opposite of the tines 18, 20. Wires 30 have insulated jackets, a portion of which is stripped from the end for electrically joining the wire 30 to the wire termination portion 28. The wires 30 may be soldered, welded or crimped into the wire termination portion 28.

The housing is designed to insulate the furcated contact lower tine 20 from the bottom and edge of the circuit board 12. An insulating layer 36 of the housing 16 provides the electrical isolation of the lower tine 20 from the PC card 12. In one embodiment, the PC card 12 has an aluminum core for improved heat dissipation characteristics and rigidity. Alternatively, the PC card 12 may comprise a conventional epoxy resin substrate.

Figure 3:
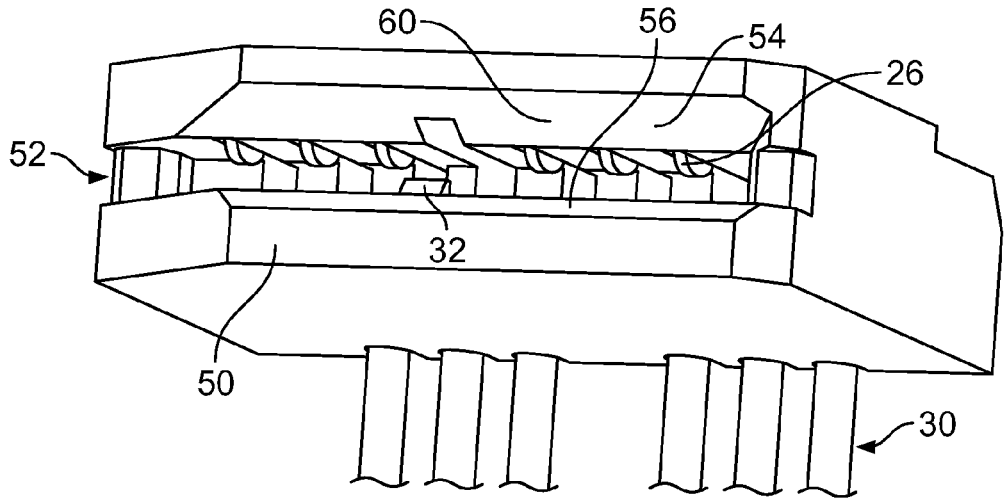
FIG. 3 is an end view of the contact portion of the connector.

FIG. 3 is a mating end view of the contact portion of the connector 10. The forward end 50 has a slot 52 having a width approximately equal to, or slightly greater, than the thickness of the PC card 12 substrate, so that the connector 10 engages with the PC card 12 in an interference fit with the contact interface 26. Opposing surfaces 54, 56 adjacent either side of the slot 52 are tapered from a wider dimension at front surface 50 to a narrower dimension at the rear of the slot 52, to promote engagement of the connector 10 and PC card 12, and prevent interference when joining them together. Also shown are the contact interfaces 26, which project downward into the slot 52 from the top portion 60, to engage the plated contact pads 24 (See, e.g., FIG. 2). Detent latch 32 is disposed adjacent the forward edge 50 of the connector.

Figure 4:
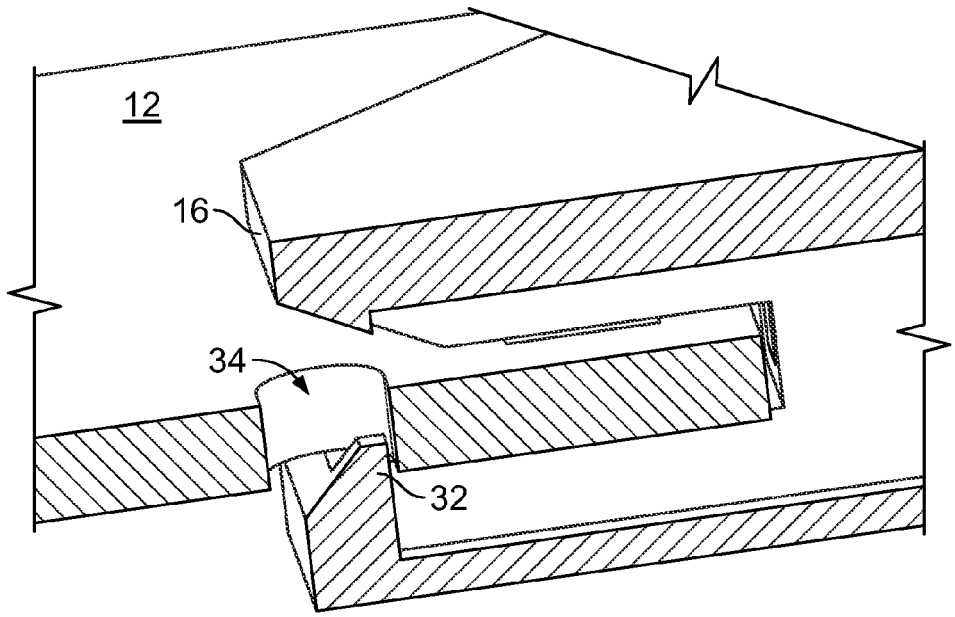
FIG. 4 is a partial sectional view showing the PC card detent latch.
Figure 5:
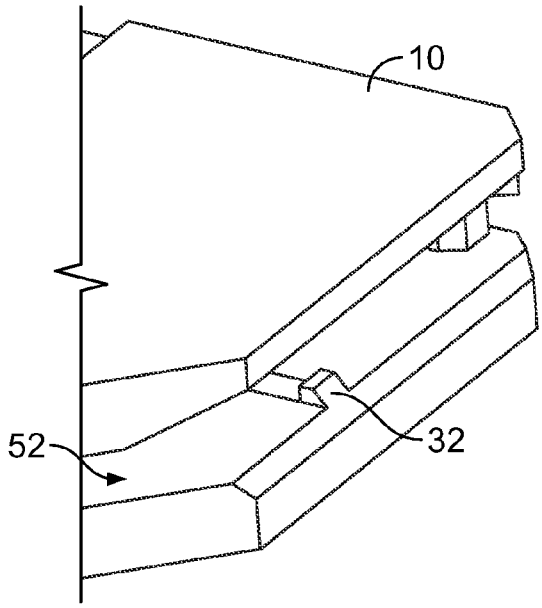
FIG. 5 is a perspective view of the connector.

Referring next to FIGS. 4 and 5, in one embodiment of the connector 10 the detent latch 32 engages an aperture 34 positioned in the PC card 12. The aperture 34 and detent latch 32 provide retention between the housing portion 16 and the PC card 12. The detent latch 32 provides additional retention force of the connector 10 to the PC card 12 that supplements the friction retention imparted by the normal force of the contact elements 14 in engagement with the PC card contact pads 24. The contacts may be arranged at a predetermined pitch with respect to the PC card 12 for facilitating alignment with the PC card 12.

Figure 6:
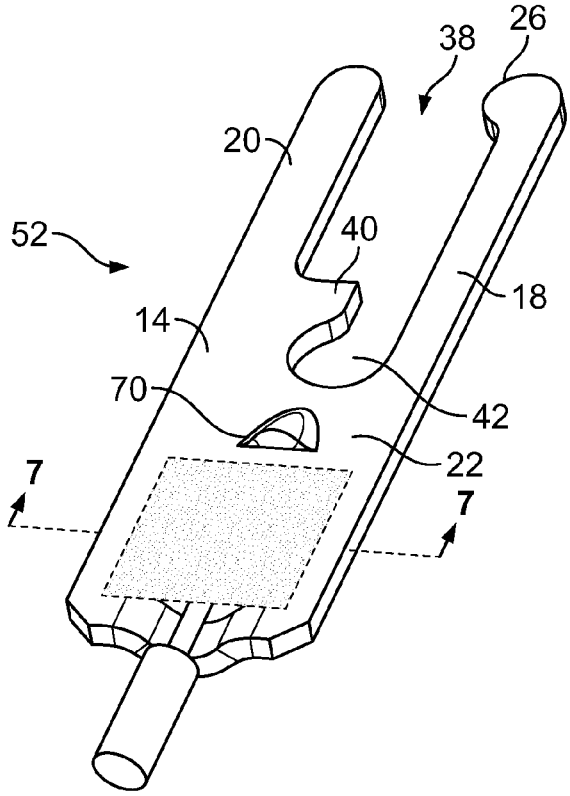
FIG. 6 is a view of a single contact element.

FIG. 6 is an isolated view of a contact element 14 apart from the connector housing 16. The contact element 14 may be configured with a slot 38 having a projection 40 defining a secondary slot 42. The contact element 14 is retained within the housing by detent 70. Web portion 22 connects tines 18, 20, with sufficient cross-sectional area to inhibit angular flexing and stress relaxation of the tines 18, 20. The contact guide channel 66 (See, e.g., FIG. 8) also restricts angular flexing of tines 18, 20 within the width of the guide channel 66. The tines 18, 20, contact interface 26, projection 40, wire termination portion 28, slot 38, secondary slot 42, and other features of the contact element 14 may be stamped from a flat metallic strip of copper or copper-alloy, as described above.

Figure 7:
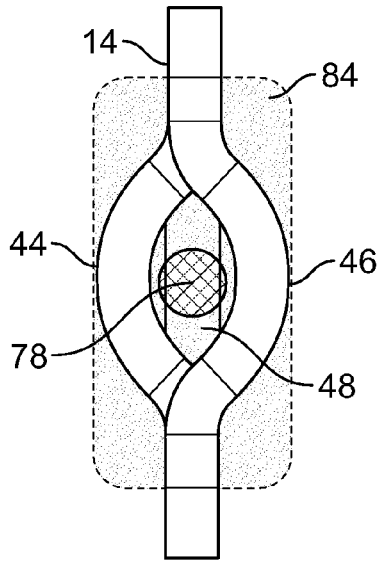
FIG. 7 is an end view of the contact portion taken along the lines 7-7 in FIG. 6.

Referring to FIG. 7, an end view of the contact portion 14 shows alternating beam portions 44,46 formed in the wire termination portion to provide an aperture or solder cup 48 for inserting stripped wire ends 78 into the wire termination portion 28, where the wire ends are soldered to the wire termination portion 28 by a soldering material (designated by hashing 84). In one embodiment, the alternating beams 44, 46 are formed outwardly on opposing sides of the centerline of the contact portion 14 to allow for the wire to be aligned with the centerline of the contact portion 14 when inserted.

Figure 8:
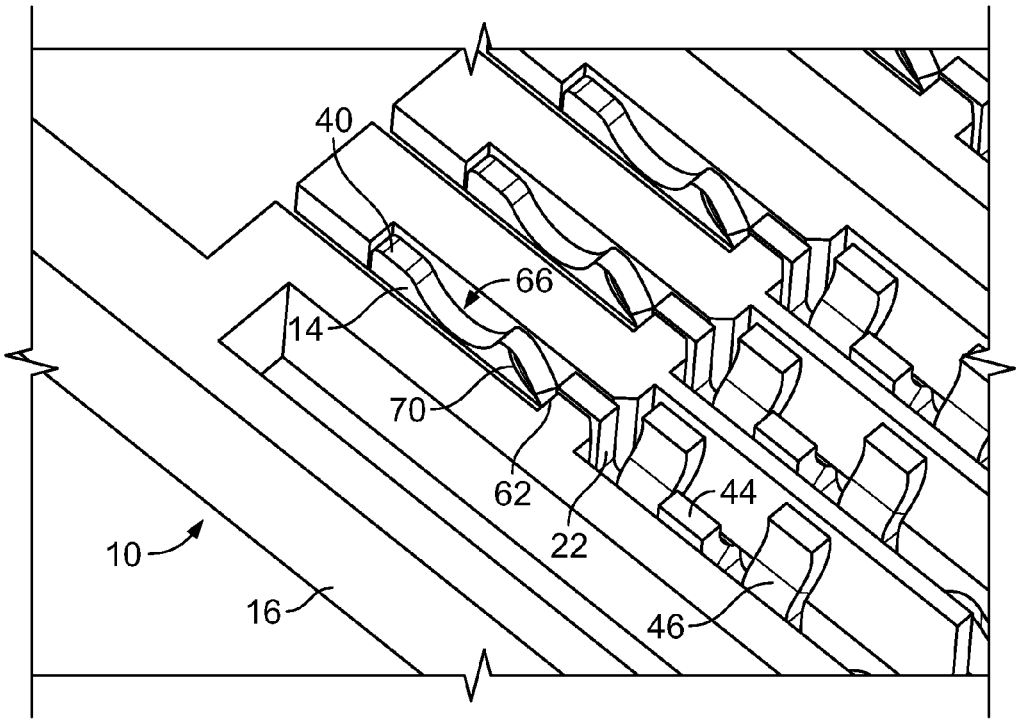
FIG. 8 is a cross-sectional view through the connector.

Referring next to FIG. 8, a cross-sectional view through the connector 10 shows the contact detent 70 engaging the shelf portion 62 of the housing portion 16. The alternating beam portions 44, 46 of the contact portion 14 are separated from the detent portion 70 by the shelf portion 62. The shelf portion 62 latches the contact portion 14 into the housing portion 16 when the contact portion 14 is fully inserted into the guide channel 66. The projection 40 abuts the end of guide channel 66 opposite the shelf portion 62, to limit the penetration of the contact portion 14 in the housing portion 16.

Figure 9:
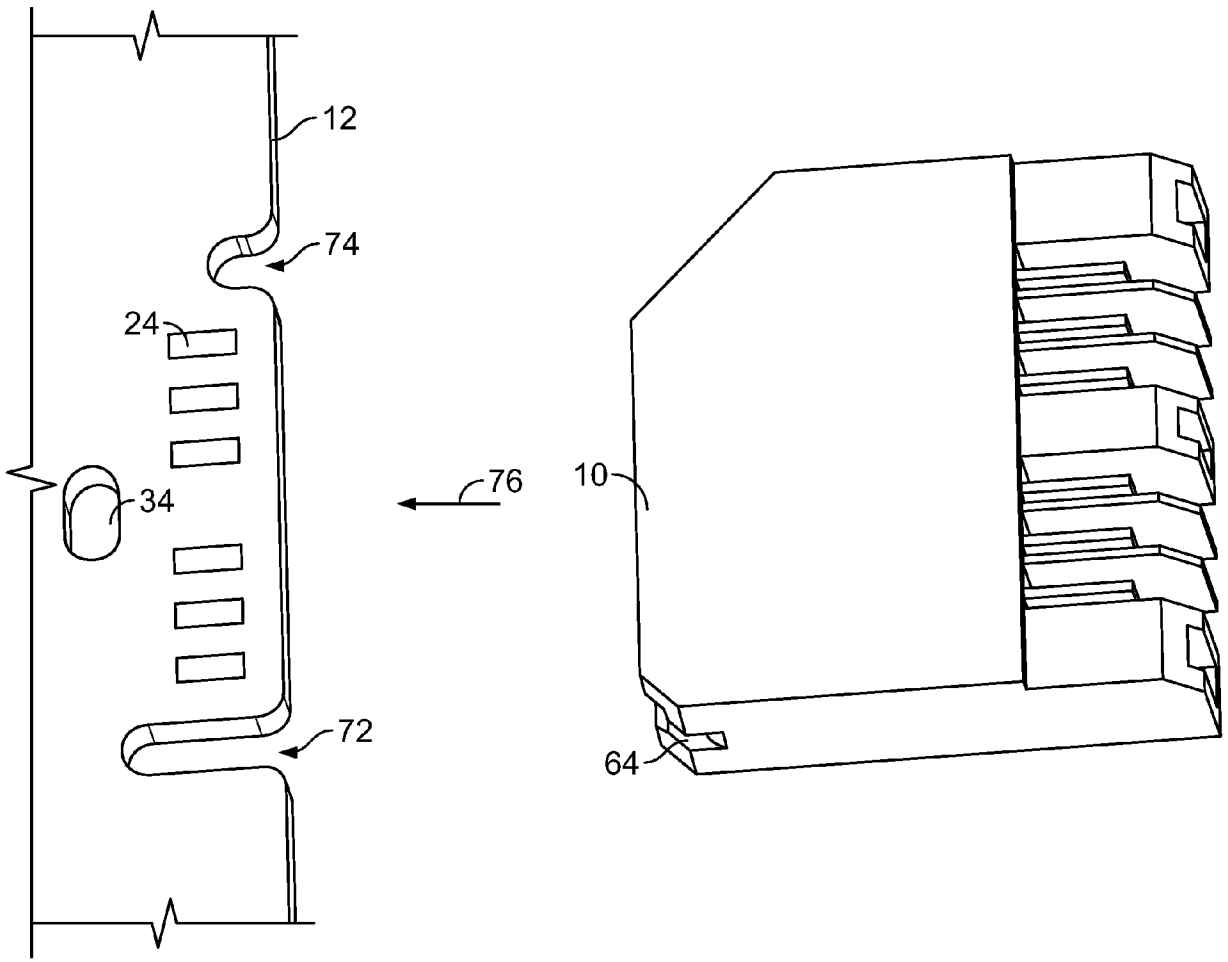
FIG. 9 is a perspective view of the connector and a PCB.
Figure 10:
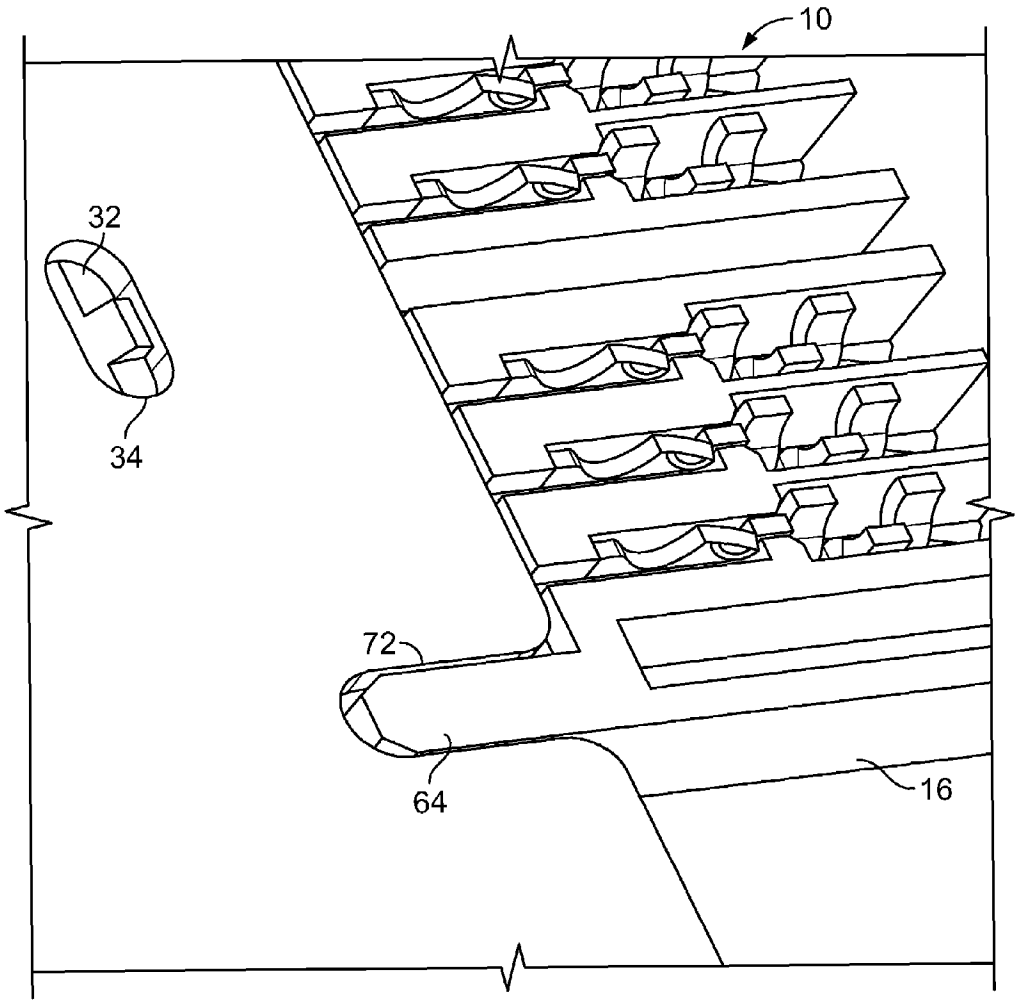
FIG. 10 is a cross-sectional view of the connector housing engaging the PCB.

Referring next to FIGS. 9 and 10, in one embodiment alignment slots 72, 74 may be disposed on the PCB or mating cable connector 12, to align. When the connector 10 is coupled together with the PCB 12, indicated by arrow 76, housing wall 64 engages with alignment slot 72 to align them relative to each other, and to ensure proper polarity. A second alignment 72 slot may be provided at the opposite end of the connector 10, for engaging a housing wall 64. Alignment may be further ensured by aperture 34 if a detent portion 32 is used to prevent the housing portion 16 from receding from the PCB 12.

Figure 11:
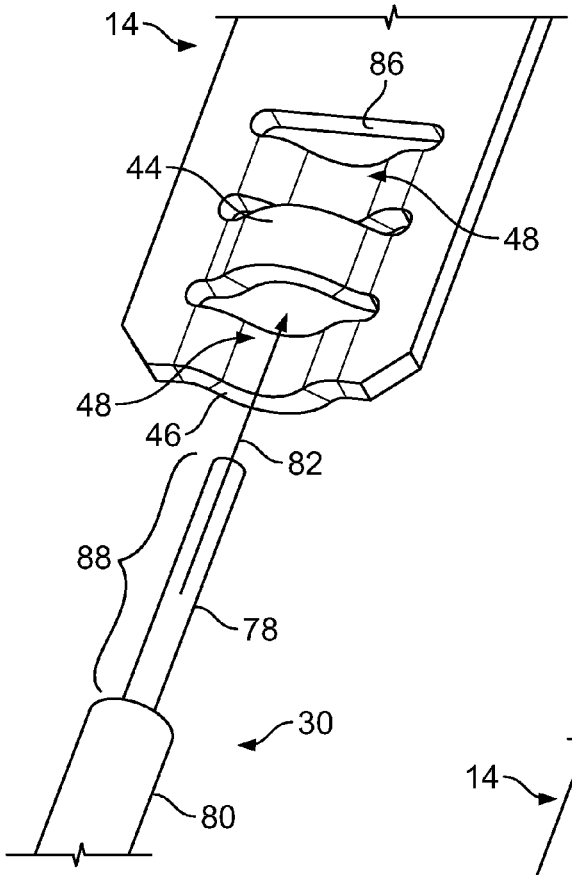
FIG. 11 is a partial perspective view of a wire being inserted into the contact termination.
Figure 12:
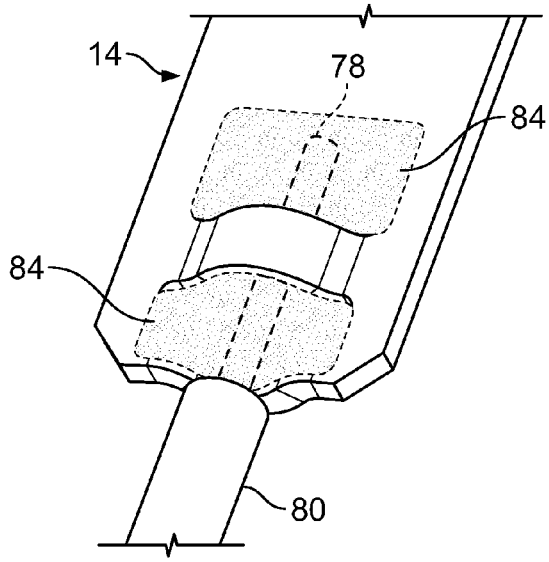
FIG. 12 is a partial perspective view of a wire soldered within the contact termination.

Referring next to FIGS. 11 and 12, in one embodiment there is a novel configuration for the solder cup 48 that provides a soldered connection (designated by the cross-hatching 84) that allows the soldered connections to have a narrow profile, and thus enabling a smaller connector 10, or an increased number of wires across the width of the connector 10. The wire 30 includes an insulation jacket 80 surrounding a conductor core 78. The jacket 80 is stripped away from the core 78 at an end portion 88, and the core 78 is inserted, as indicated by arrow 82, into the solder cups 48 that are defined between opposing beam portions 44 and 46. The wire is maintained approximately at the axis or centerline of the contact portion 14 by the beam portions 44 and 46 and solder cups 48. The core 78 may be inserted into the solder cup 48 and soldered by conventional soldering means. Alternately the core 48 may be pre-coated with a tin or tin alloy layer designed to re-flow when heated to bond the wire core 78 to the contact portion 14.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector for connecting a cable to a card edge interface, comprising:

a housing portion having a first surface and a second surface opposite said first surface, and an insulating portion disposed between the first surface and the second surface, the first surface, the insulating portion and the second surface being spaced apart to define a slot; and a plurality of furcated contact elements disposed within the housing;

each furcated contact element having:

a first tine portion having a contact interface portion, a second tine portion spaced apart from the first tine portion; a web portion connecting the first and second tine portions at one end, and a wire termination portion attached to the web portion for terminating a conductor of the cable;

the second tine portion disposed between the insulating portion and the second surface to insulate the second tine portion from electrical contact with the card edge interface;

wherein the first and second tine portions define an open recess corresponding with the slot of the housing portion, and are arranged within the housing portion with the contact interface exposed for mating with a respective contact surface of the card edge interface.

2. The electrical connector of claim 1, wherein the contact element imparts normal contact force for stabilizing connection to the plated contacts of the PC card.

3. The electrical connector of claim 1, wherein the web portion provides a reinforced joint between the upper and lower tine portions.

4. The electrical connector of claim 1, the contact element further including a detent element, and the housing portion having a plurality of guide channels for aligning the plurality of contact elements, and associated with each guide channel of the plurality of guide channels, a shelf portion for engaging the respective detent element.

5. The electrical connector of claim 1, wherein each contact element of the plurality of contact elements is resistant to metal deformation.

6. The electrical connector of claim 1, wherein each contact element is metal plated, and is configured within the housing portion exposed for mating with a respective metal plated contact surface of the card edge interface.

7. The electrical connector of claim 5, wherein the contact element is a high-temperature copper alloy.

8. The electrical connector of claim 6, wherein the contact element is selected from the group consisting of: phosphor bronze, beryllium copper, and other copper alloy having resistance to stress relaxation.

9. The electrical connector of claim 1, wherein the wire termination portion may be electrically connected to the conductors by soldering, welding or crimping thereto.

10. The electrical connector of claim 1, further comprising a PC card associated with the card edge interface, wherein the PC card comprises an aluminum core for improved heat dissipation characteristics and rigidity.

11. The electrical connector of claim 1, further comprising a PC card attached to the card edge interface, wherein the PC card comprises a conventional epoxy resin substrate.

12. The electrical connector of claim 1, wherein the housing portion slot is dimensioned approximately equal to, or slightly greater, than the thickness of the card edge interface, and configure to engage the connector with the PC card.

13. The electrical connector of claim 1, wherein the first and second opposing surfaces further include a tapered from a front surface towards a rear portion of the slot, for engagement of the connector with the PC card.

14. The electrical connector of claim 1, the housing portion further includes at least one wall portion, and the PC card edge surface having at least one notch matable with the at least one wall portion, wherein the at least one wall portion is configured to ensure polarity and alignment of the housing portion with the PC card edge.

15. The electrical connector of claim 1, wherein the first surface further includes a detent latch disposed for engagement with an aperture positioned in a PC card associated with the card edge interface, for aligning the contact elements with the contact surfaces.

16. The electrical connector of claim 1, wherein the housing portion is constructed of electrical insulation material.

17. An electrical connector for connecting a cable to a card edge interface, comprising:

a housing portion having a first surface and a second surface opposite said first surface, and an insulating portion disposed between the first surface and the second surface, the first surface, the insulating portion and the second surface being spaced apart to define a housing portion slot for receiving the card edge interface; and a plurality of furcated contact elements disposed within the housing;

each furcated contact element having:

a first tine portion having a contact interface portion, a second tine portion spaced apart from the first tine portion; a web portion connecting the first and second tine portions at one end; a detent element formed in the web portion; and a wire termination portion attached to the web portion for terminating a conductor of the cable; and the second tine portion disposed between the insulating portion and the second surface to insulate the second tine portion from electrical contact with the card edge interface;

wherein the first and second tine portions define an open recess corresponding with the housing portion slot, and are arranged within the housing portion with the contact interface exposed for mating with a respective contact surface of the card edge interface; and wherein each contact element is configured with a first slot having a projection configured to abut the card edge interface when the housing portion is engaged with the card edge interface, and the detent element is configured to detachably engage an aperture on a card associated with the card edge interface.

* * * * *